US008859921B2

(12) United States Patent
Chiba

(10) Patent No.: US 8,859,921 B2
(45) Date of Patent: Oct. 14, 2014

(54) SWITCH DEVICE

(75) Inventor: Shingo Chiba, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/807,772

(22) PCT Filed: Jul. 1, 2011

(86) PCT No.: PCT/JP2011/065643

§ 371 (c)(1),
(2), (4) Date: Dec. 31, 2012

(87) PCT Pub. No.: WO2012/002581

PCT Pub. Date: Jan. 5, 2012

(65) Prior Publication Data

US 2013/0098747 A1 Apr. 25, 2013

(30) Foreign Application Priority Data

Jul. 2, 2010 (JP) ..... 2010-151725

(51) Int. Cl.
*H01H 15/10* (2006.01)

(52) U.S. Cl.
USPC ..... 200/547

(58) Field of Classification Search
USPC ..... 200/511, 339, 61.54–61.57, 553, 547
See application file for complete search history.

(56) References Cited

U.S. PATENT DOCUMENTS

| | | | | |
|---|---|---|---|---|
| 5,051,549 | A | 9/1991 | Takano | |
| 5,786,554 | A * | 7/1998 | Umezawa et al. | 200/61.88 |
| 2005/0258023 | A1 * | 11/2005 | Nagai et al. | 200/339 |
| 2008/0302646 | A1 * | 12/2008 | Nagai et al. | 200/339 |

FOREIGN PATENT DOCUMENTS

| | | | |
|---|---|---|---|
| DE | 2132158 | A1 | 4/1972 |
| DE | 19713978 | A1 | 10/1997 |
| FR | 2906641 | A1 | 4/2008 |
| JP | 42-1072 | U | 1/1942 |
| JP | 04-017228 | A | 1/1992 |
| JP | 10-69839 | A | 3/1998 |
| JP | 2003234036 | A | 8/2003 |
| JP | 200891212 | A | 4/2008 |
| WO | 02103850 | A2 | 12/2002 |

OTHER PUBLICATIONS

International Search Report dated Oct. 20, 2011 from the International Searching Authority in counterpart application No. PCT/JP2011/065643.

(Continued)

*Primary Examiner* — Edwin A. Leon
(74) *Attorney, Agent, or Firm* — Sughrue Mion, PLLC

(57) ABSTRACT

A switch device including arm springs as movable contacts slide in accordance with a switching operation of a switch knob. The arm springs come into resilient contact and slide on movable contact slide parts. Root parts and mountain parts are formed in the movable contact slide parts and a fixed contact is formed with end edges of bus bars. The bus bars are mounted and fixed to an upper surface of a support part. A cut out part is provided on the upper surface of the support part. The arm springs are formed in the shapes of bars having mountain forms in section fitted to the root parts, and the arm springs are extended in the vertical direction to plate surfaces of the bus bars and arranged to be inclined so that outer side surfaces abut on upper side edges of the fixed contacts.

3 Claims, 16 Drawing Sheets

(56) References Cited

OTHER PUBLICATIONS

Written Opinion dated Oct. 20, 2011 from the International Searching Authority in counterpart application No. PCT/JP2011/065643.
Office Action dated Feb. 11, 2014 issued by the Korean Intellectual Property Office in counterpart Korean Patent Application No. 10-2012-7034436.
Japanese Office Action issued Jun. 3, 2014 in a corresponding Japanese Patent Application No. 2010-151725.
Notification of the First Office Action and English translation in corresponding Chinese application No. 201180033179.5, issued Aug. 4, 2014.
Korean Office Action issued Aug. 26, 2014 in corresponding Korean application No. 10-2012-7034436 and English translation thereof.

* cited by examiner

SWITCH DEVICE

TECHNICAL FIELD

The present invention relates to a switch device used for an indoor lighting device for a vehicle, and more particularly to a switch device using bus bars for wiring as a fixed contact.

BACKGROUND ART

As the switch device employed for such kind of use, a switch device disclosed in JP-A-2008-91212 is known. FIGS. 14 to 16 show an example of a seesaw type switch device disclosed in JP-A-2008-91212.

This switch device 170 includes a switch lever 171, a switch cover 172, a switch base 173 and a switch knob 174 and is attached to a functional part housing 175 and a design part cover 176 of an indoor lighting device for a vehicle. The switch base 173 is fixed to the functional part housing 175 and an operating part of the switch knob 174 is exposed outside from an opening 176*a* of the design part cover 176. The switch base 173 is connected to the switch cover 172 with the switch lever 171 accommodated therein.

The switch lever 171 and the switch knob 174 are attached so as to be freely swung on a supporting point 178 for swing. In a lower part of the switch lever 171, a through hole 171*a* is formed and a spring 171*e* is accommodated in the through hole 171*a*. In one end side of the spring 171*e*, an engaging ball 171*f* is arranged. In the other end side of the spring, a movable contact 171*g* is arranged. The engaging ball 171*f* is resiliently urged by the spring 171*e*.

In the switch base 173, a rectangular tubular member 173*b* is provided. In one inner side surface of opposed inner side surfaces of the tubular member 173*b*, a plurality of vertical grooves 173*d* are formed. On the other inner side surface, fixed contacts 173*e* formed respectively with parts of bus bars are arranged. In this case, the fixed contacts 173*e* are arranged by setting plate surfaces of parts of the bus bars as a set of contact parts relative to the movable contact 171*g*.

Then, under a state that the switch lever 171 is attached to the switch base 173, the engaging ball 171*f* slides on the inner side surface on which the vertical grooves 173*d* are formed and the movable contact 171*g* slides on the inner side surface on which the fixed contacts 173*e* are arranged. When the engaging ball 171*f* is fitted to the vertical groove 173*d*, the switch lever 171 is positioned at a prescribed position. Accordingly, in accordance with a switching operation of the switch lever 171 and the switch knob 174 to which a sense of moderation is given due to a positioning operation, a connection of the fixed contacts 173*e* and the movable contact 171*g* can be switched.

JP-A-2008-91212 is discussed in the above as background art.

SUMMARY OF THE INVENTION

Technical Problem

In the above-described usual switch device 170, since the spring 171*e* or the engaging ball 171*f* are attached to the through hole 171*a* of the switch lever 171 in order to apply a sense of moderation to the operation of the switch knob 174, the number of parts is increased and the number of attaching processes is increased so that a cost is apt to be high. Further, since a plate surface of the movable contact 171*g* comes into contact with the fixed contacts 173*e* formed respectively with the plate surfaces of parts of the bus bars, a limitation is liable to arise to improve reliability in connection between the fixed contacts 173*e* and the movable contact 171*g*.

The present invention is devised by considering the above-described circumstances and it is an object of the present invention to provide a switch device that can lower a cost by reducing the number of parts and the number of attaching processes and can improve reliability in a connection between fixed contacts and movable contacts.

Solution to Problem

In order to achieve the above-described object, a switch device according to the present invention features the following aspects (1) to (3).

(1) A switch device includes: a main body having a housing made of an insulating resin and bus bars made of an electrically conductive material; a switch knob provided on the main body so as to be switched; movable contacts having a resiliency that slide in accordance with a switching operation of the switch knob; movable contact slide parts provided in the main body on which the movable contacts come into resilient contact and slide; a plurality of root parts and mountain parts between the root parts which are formed in the movable contact slide parts and with which the movable contacts can be selectively engaged; and fixed contacts formed with end edges of the bus bars and provided in the root parts, and is characterized in that the movable contacts slide so that engaging positions of the movable contacts are switched from one root parts of the plurality of root parts to the other root parts to switch a connecting relation between the movable contacts and the fixed contacts.

(2) In the switch device having the structure of the above-described (1), the bus bars are mounted and fixed to an upper surface of a bus bar support part provided in the housing, a cut out part which allows the end edges of the bus bars as the fixed contact to protrude outward from the bus bar support part is provided on the upper surface of the bus bar support part, the movable contacts are formed in the shapes of bars having mountain forms in section fitted to the root parts, and the movable contacts are extended in the vertical direction to plate surfaces of the bus bars and arranged to be inclined so that outer side surfaces abut on upper side edges of the fixed contacts.

(3) In the switch device having the structure of the above-described (1) or (2), the movable contact slide parts are arranged to be opposed to each other with a slide space sandwiched between them, the plurality of root parts and the mountain parts between the root parts are respectively provided in the movable contact slide parts arranged to be opposed to each other, the switch knob is formed as a seesaw switch knob provided in the housing so as to freely swing, a contact member is attached to the switch knob, two arm springs as the movable contacts are formed in the contact member in the shape of V, and the two arm springs are inserted into the slide space between the movable contact slide parts arranged to be opposed to each other so that the arm springs may freely slide respectively relative to the movable contact slide parts.

According to the switch device having the structure of the above-described (1), since the end edges of parts of the bus bars are used as the fixed contacts and the movable contacts abut on the end edges, dust or a foreign material is hardly interposed between the fixed contacts and the movable contacts. Thus, reliability in a connection between the fixed contacts and the movable contacts can be improved. Further, since the root parts and the mountain parts are provided in the movable contact slide parts and the movable contacts having a resiliency are allowed to slide on the movable contact slide parts having the root parts and the mountain parts, a sense of moderation (a switching feeling) can be given to the operation of the switch knobby a simple structure without using the spring or the engaging ball. Accordingly, the number of parts is reduced and the number of attaching processes is reduced, so that a cost can be lowered.

According to the switch device having the structure of the above-described (2), the cut out parts are provided in the bus bar support part of the housing so that the end edges of the bus bars as the fixed contacts are allowed to protrude outside from the bus bar support part, and further, the movable contacts are arranged to be inclined to the bus bars so that the outer side surfaces of the bar shaped movable contacts having the mountain forms in section abut on the upper side edges of the fixed contacts. Accordingly, even when a small attaching error occurs between the housing, the bus bars and the movable contacts or work errors slightly occur in these parts respectively, the movable contacts can be assuredly allowed to come into contact with the fixed contacts to avoid an imperfect electric conduction.

According to the switch device having the structure of the above-described (3), since the two arm springs as the movable contacts are provided in the contact member in the form of V and the arm springs are allowed to slide on the movable contact slide parts opposed to each other with the slide space of the arm springs sandwiched between them, the fixed contact arranged in one movable contact slide part side can be electrically conducted to the fixed contact arranged in the other movable contact slide part side through the contact member. Namely, the two bus bars can be connected to each other or disconnected from each other by a simple structure.

Advantageous Effects of Invention

According to the present invention, reliability in a connection between a fixed contact and a movable contact can be improved, a sense of moderation can be given to an operation of a switch knob by a simple structure and a cost can be lowered by reducing the number of parts and the number of attaching processes.

The present invention is briefly explained as described above. Further, a detail of the present invention will be more clearly understood by reading a mode for carrying out the invention, which will be described below, by referring to the attached drawings.

BRIEF DESCRIPTION OF THE DRAWINGS

FIG. 2(*a*) is a view showing a state before the switch knob is attached to the contact member. FIG. 2(*b*) is a view showing a state after the switch knob is attached to the contact member.

FIG. 3(*a*) is a view showing a state before the bus bars are attached to a back surface of the housing. FIG. 3(*b*) is a view showing a state after the bus bars are attached to aback surface of the housing.

FIG. 8(*a*) is a perspective view seen from the front surface side. FIG. 8(*b*) is a perspective view seen from the back surface side.

FIG. 9(*a*) is a perspective view and FIG. 9(*b*) is a sectional view taken along a line IXb-IXb of FIG. 9(*a*).

FIG. 10(*a*) is a perspective view and FIG. 10(*b*) is a sectional view taken along a line Xb-Xb in FIG. 10(*a*).

DESCRIPTION OF EMBODIMENTS

Now, an indoor lighting device for a ceiling of a vehicle including a switch device of an exemplary embodiment of the present invention will be described below.

Figure 1:
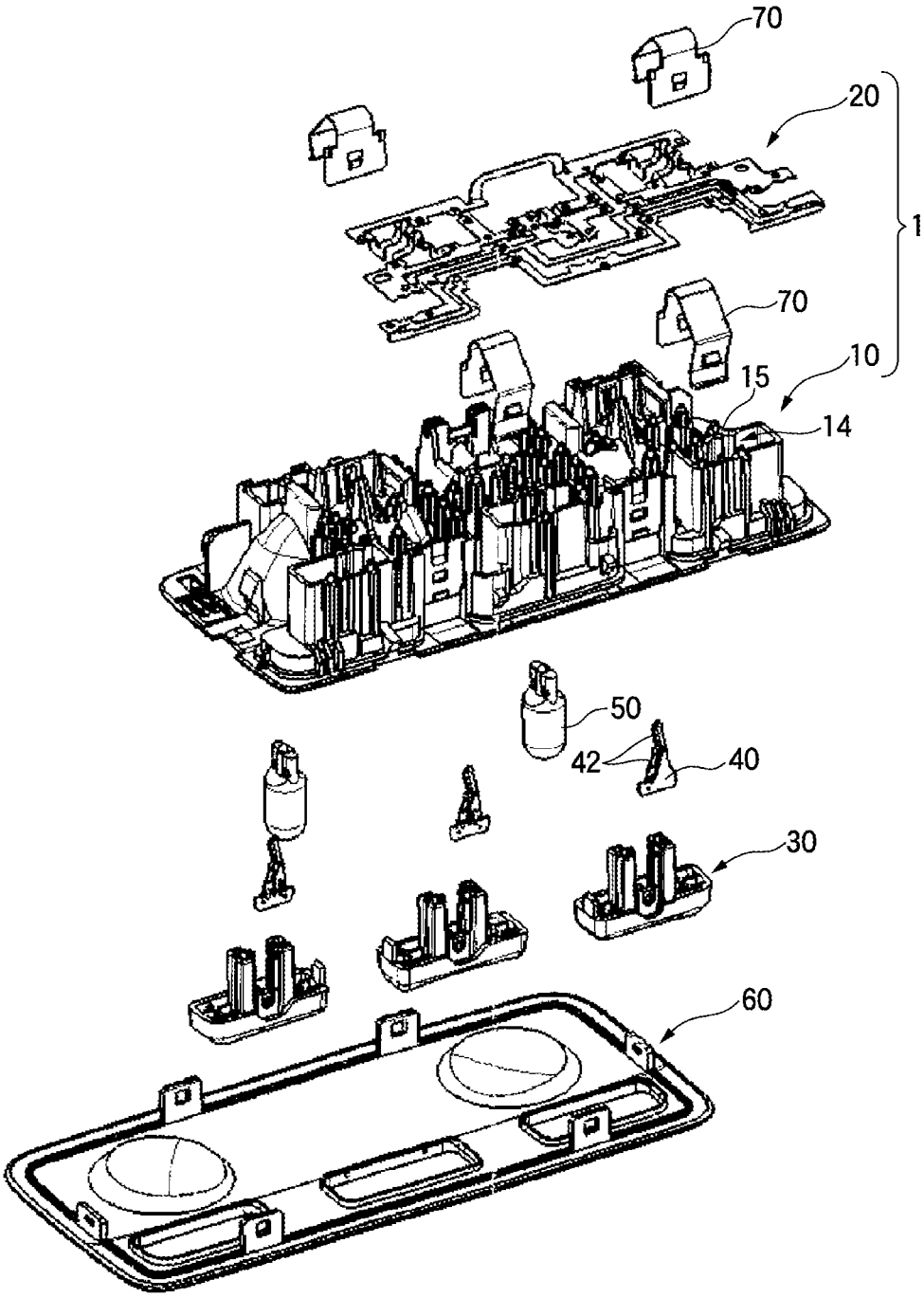
FIG. 1 is an exploded perspective view of an indoor lighting device for a ceiling of a vehicle including a switch device of an exemplary embodiment of the present invention.

FIG. 1 is an exploded perspective view of the indoor lighting device for the ceiling of the vehicle.

As shown in FIG. 1, the indoor lighting device for the ceiling of the vehicle includes a main body 1 as a functional part and a cover 60 having a lens as a design part. Since the main body 1 and the cover 60 hold a vertical direction shown in FIG. 1 and are attached to the ceiling part of the vehicle, the vertical direction is prescribed in accordance with the direction of the drawing in this specification. The main body 1 includes a housing 10 made of an insulating resin and a bus bar 20 formed with a metal plate (made of an electrically conductive material). To the housing 10, a switch knob 30 and a bulb 50 are attached, and a contact member 40 is attached to the switch knob 30. Further, to a side part of the housing 10, a metal clip 70 is attached for fixing the indoor lighting device for the ceiling of the vehicle to a ceiling plate of the vehicle.

Figure 2:
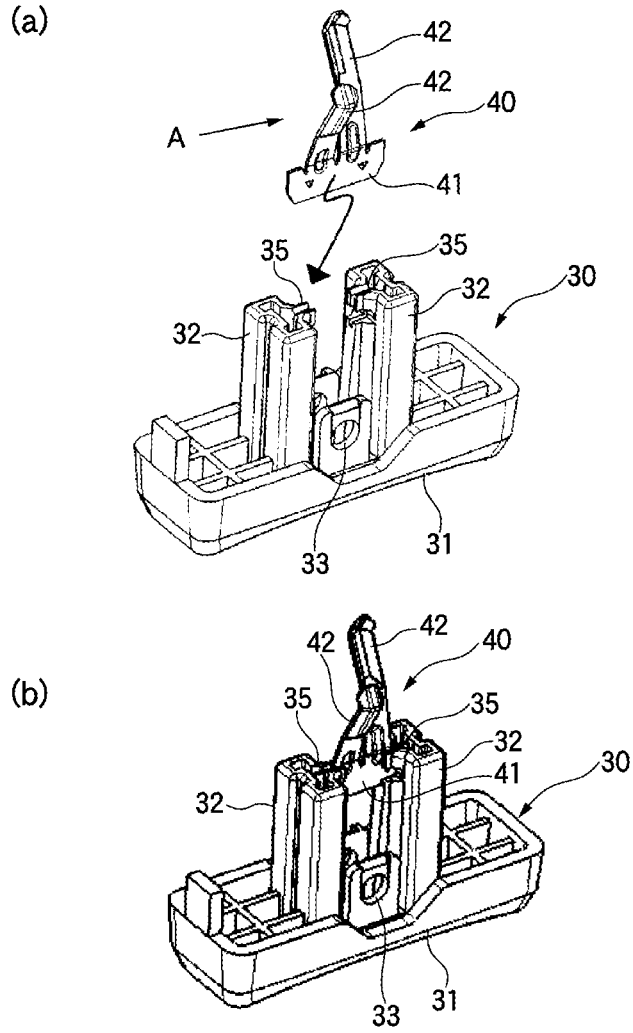
FIG. 2 is a perspective view showing a relation of a switch knob and a contact member as main parts of the switch device.

FIG. 2 is a perspective view showing a relation of the switch knob and the contact member as main parts of the switch device of the exemplary embodiment. FIG. 2(*a*) is a view showing a state before the switch knob is attached to the contact member. FIG. 2(*b*) is a view showing a state after the switch knob is attached to the contact member.

The switch knob 30 is a seesaw switch knob and includes a rectangular plate shaped operating part 31, a pair of struts 32 protruding on a back surface of the operating part 31, a shaft hole 33 formed on a protruding piece between the struts 32 and attaching grooves 35 provided in opposed inner side surfaces of the struts 32. The contact member 40 is formed by press working one metal plate and includes a flat plate shaped base plate part 41 and two arm springs 42 protruding from the base plate part 41. The two arm springs 42 shift in position in the longitudinal direction of the base plate part 41 (a slide direction of the below-described contact member 40). When the arm springs are seen from a direction shown by an arrow mark A in FIG. 2(*a*), the arm springs 42 are extended in the shape of V by setting the base plate part 41 as an origin and ends of the arm springs 42 are respectively bent inside in the shapes of <. The two arm springs 42 function as movable contacts and are formed in bars of mountain shapes in section in which outer side surfaces protrude so as to be engaged with below-described root parts 14*a*. Then, the contact member 40 is attached integrally to a back surface side of the switch knob 30 by pressing-in both side edges of the base plate part 41 to the attaching grooves 35 of the struts 32 of the struts 32 of the switch knob 30.

Figure 3:
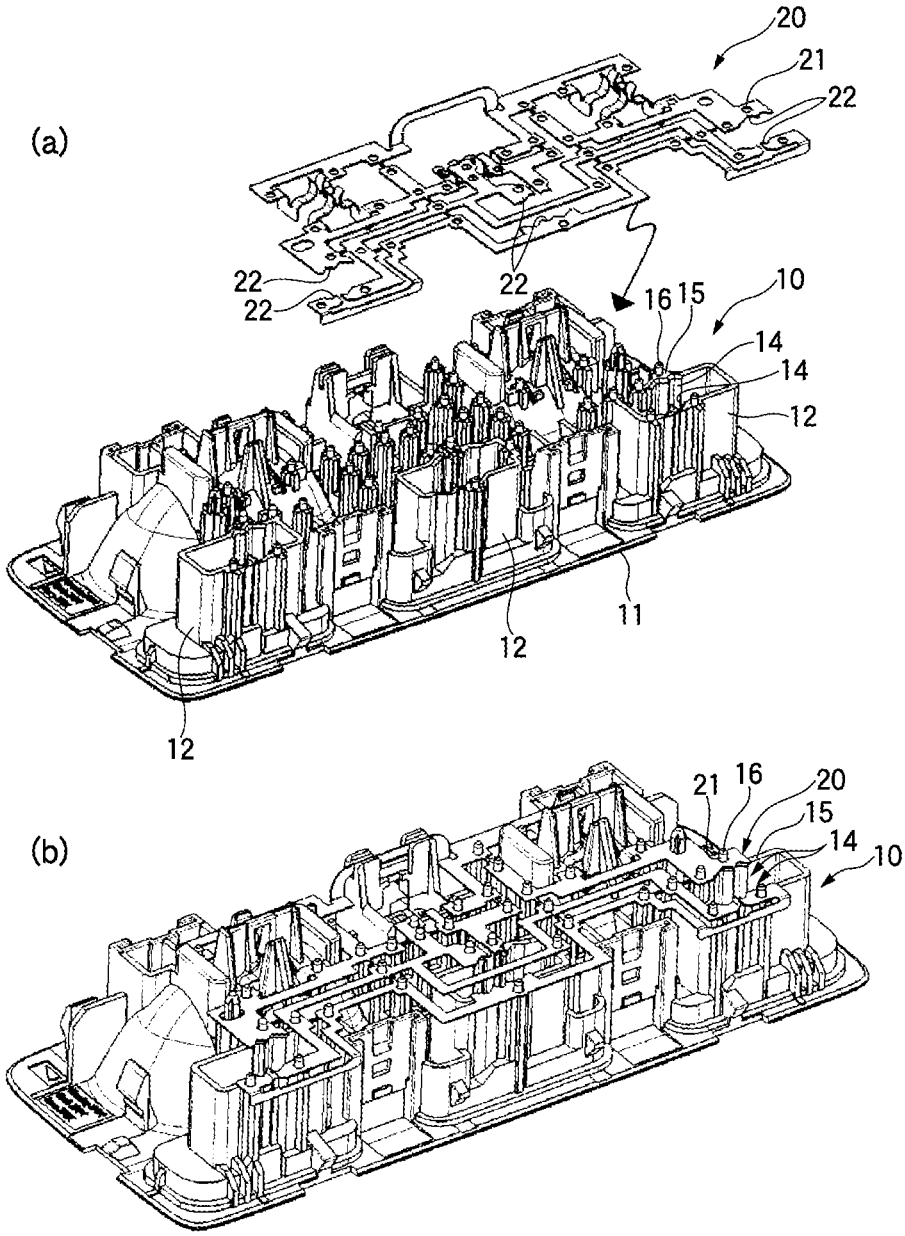
FIG. 3 is a perspective view showing a relation of a housing and bus bars of the indoor lighting device for the ceiling of the vehicle.
Figure 6:
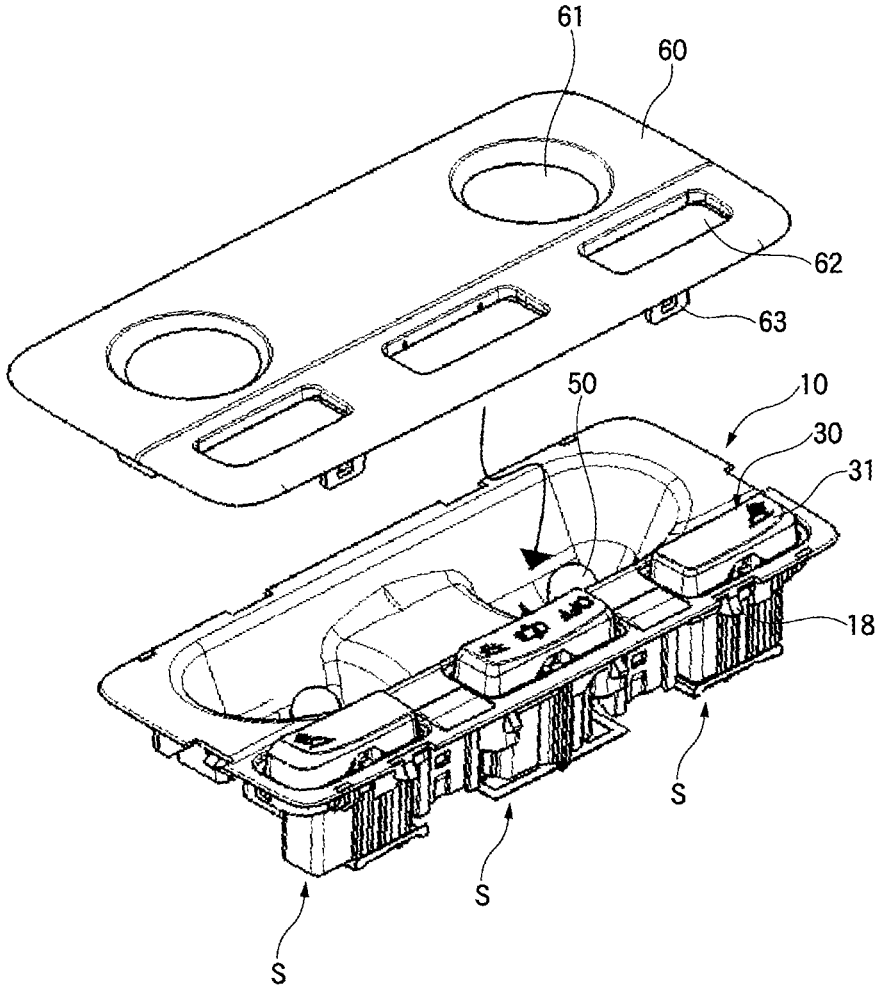
FIG. 6 is a perspective view showing a state that a cover having a lens is to be attached to the housing to which the bulb is attached.
Figure 7:
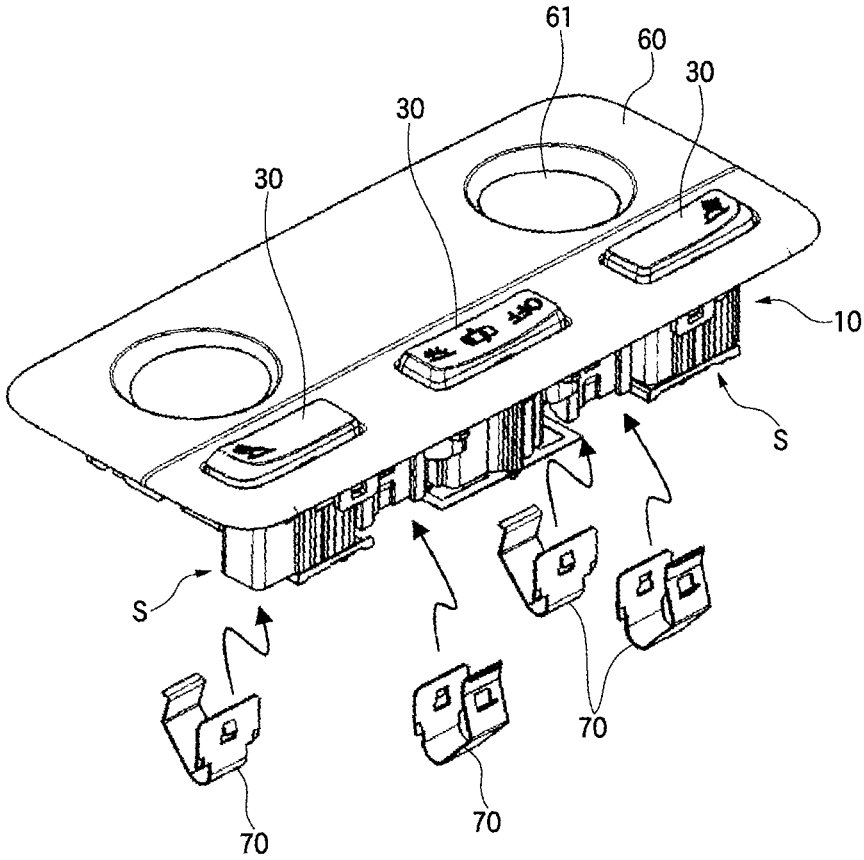
FIG. 7 is a perspective view showing a state that a metal clip is to be attached to the housing to which the cover having the lens is attached.
Figure 8:
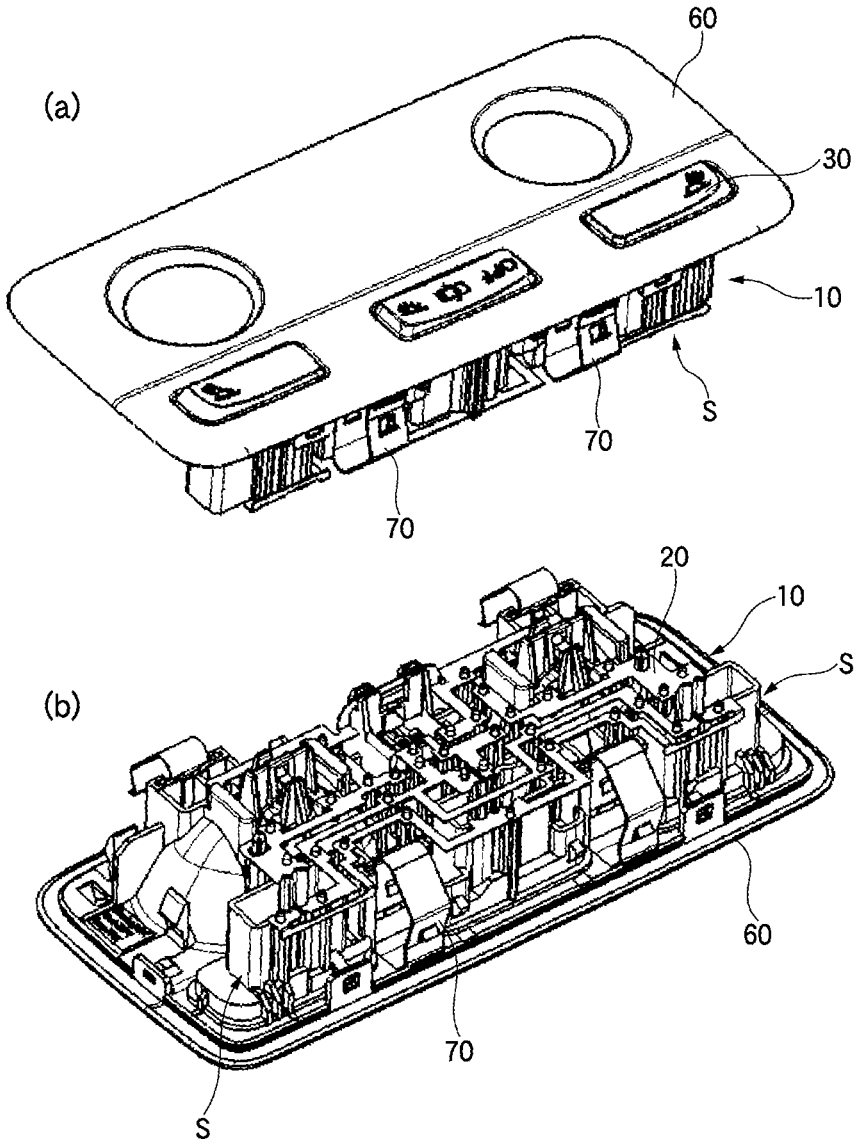
FIG. 8 is a structural view of the indoor lighting device for the ceiling of the vehicle which is completely assembled.
Figure 9:
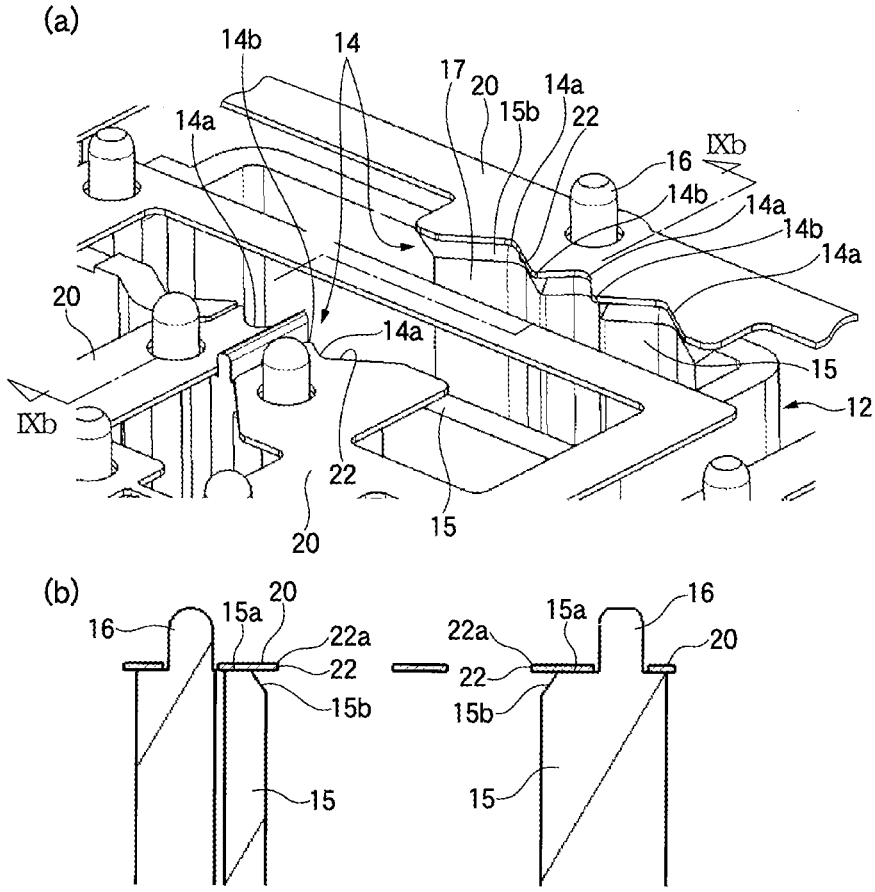
FIG. 9 is a diagram showing a structure of a fixed contact side as a main part of the switch device of the exemplary embodiment.
Figure 10:
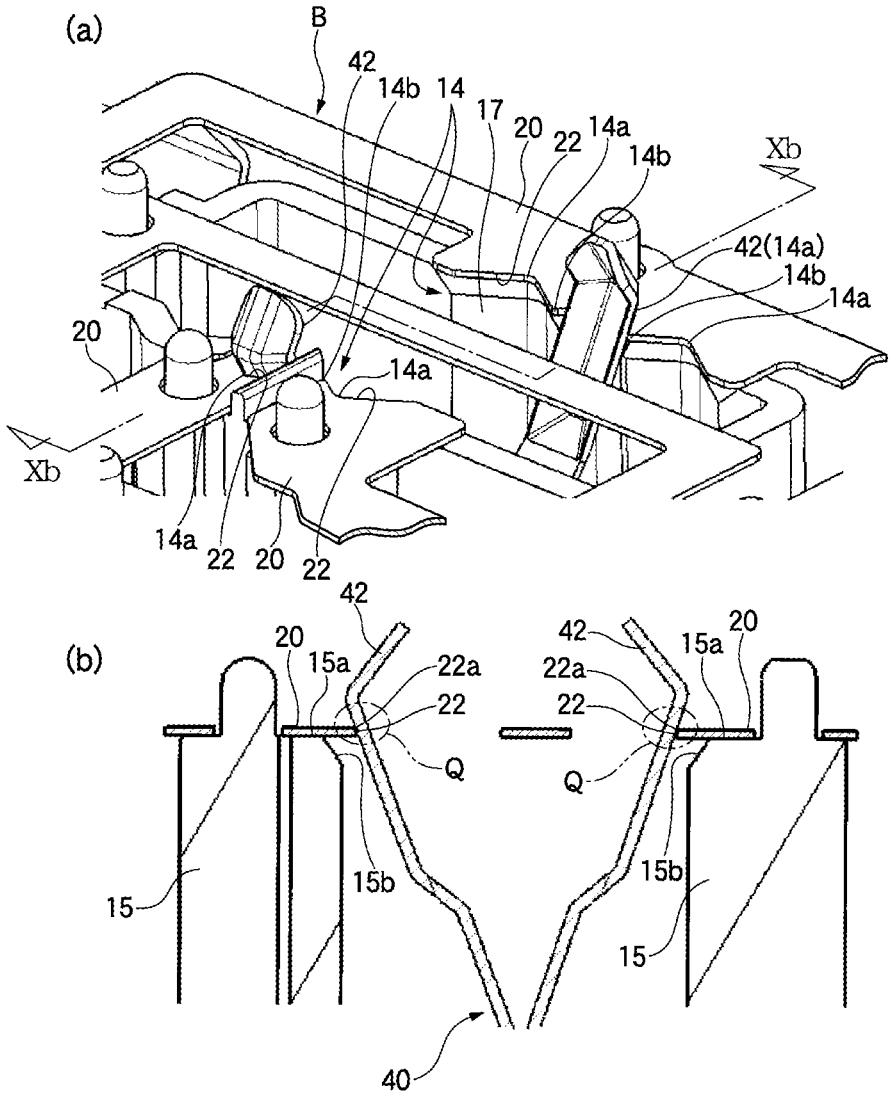
FIG. 10 is a diagram showing a state that an arm spring of the contact member side is added to the structure of the fixed contact side shown in FIG. 9.
Figure 11:
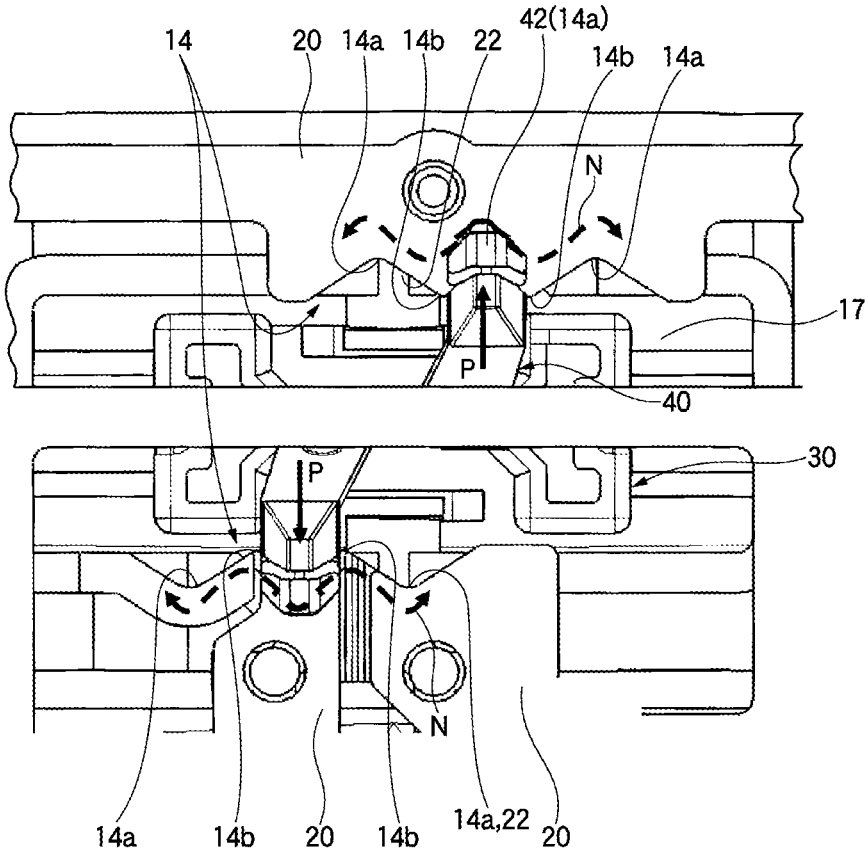
FIG. 11 is a plan view of a part shown in FIG. 10.

FIG. 3 is a perspective view showing a relation of the housing 10 and the bus bar 20 of the indoor lighting device for the ceiling of the vehicle. FIG. 3(*a*) is a view showing a state before the bus bar 20 is attached to a back surface of the housing 10. FIG. 3(*b*) is a view showing a state after the bus bar 20 is attached to the back surface of the housing 10. FIG. 4 to FIG. 7 are diagrams showing a procedure for assembling the indoor lighting device for the ceiling of the vehicle. FIG. 8 is a diagram showing that the indoor lighting device for the ceiling of the vehicle is completed. FIG. 9 is a diagram showing a structure of a fixed contact side as a main part of the switch device S. FIG. 10 is a diagram showing a state that the arm spring of the contact member side is added to the structure of the fixed contact side. FIG. 11 is a plan view of a part shown in FIG. 10.

On a back surface side (a surface side which becomes an upper side when the housing is attached to the vehicle) of a base plate 11 of the housing 10, a required number (three in this example) of rectangular tube parts 12 for forming the switch device S are provided. Further, on the back surface side of the base plate 11, a bus bar support part 15 is provided for supporting the bus bar 20 as well as the tube parts 12. The bus bars 20 are prepared for a plurality of systems and mounted on an upper surface of the bus bar support part 15 so that the bus bars do not come into contact with each other and fixed to the housing 10 by thermally welding pins 16 of the housing 10 side which pass through fixing holes 21 of the bas bars 20.

In opposed inner side surfaces of the tube part 12 of the housing 10, movable contact slide parts 14 are provided with which the arm springs 42 as the movable contacts come into resilient contact to slide. The two arm springs 42 are inserted into a slide space 17 between the movable contact slide parts opposed to each other so that the arm springs may respectively slide relative to the movable contact slide parts 14. The arm springs 42 slide along the movable contact slide parts 14 in accordance with a switch operation of the switch knob 30. Precisely, the arm springs 42 slide along circular arcs on a supporting point for swing (the shaft hole 33).

As shown in FIG. 9, the movable contact slide parts 14 are arranged to be opposed to each other with the slide space 17 of the contact member 40 sandwiched between them. The movable contact slide parts 14 arrange to be opposed to each other respectively include a plurality of root parts 14*a* with which the arm springs 42 as the movable contacts can be selectively engaged. Between the root parts 14*a* and the root parts 14*a*, mountain parts 14*b* are respectively provided. Further, in at least one of root parts 14*a* of the opposed movable contact slide parts 14, a fixed contact 22 formed with an end edge of the bus bar is arranged. The end edge of the bus bar 20 forming the fixed contact 22 is a part corresponding to the movable contact slide part 14. In the movable contact slide part 14 of the bus bar 20 side, root parts 14*a* and mountain parts 14*b* are also formed which correspond to the root parts 14*a* and the mountain parts 14*b* of the housing 10 side. In the switch device S, when the arm springs 42 slide so that engaging positions of the arm springs 42 are switched from one root part 14*a* of the plurality of root parts 14*a* to the other root part 14*a*, a connecting relation of the arm springs 42 as the movable contacts an the fixed contact 22 is switched.

Further, as shown in FIG. 9(*b*), in a corner part of an upper surface 15*a* of the bus bar support part 15, a cut out part 15*b* is provided which allows the end edge of the bus bar 20 as the fixed contact 22 to protrude outside from the bus bar support part 15. As shown in FIG. 10, the arm springs 42 as the movable contacts are extended in the vertical direction to a plate surface of the bus bar 20 and inclined so that the outer side surfaces abut on upper side edges 22*a* of the fixed contacts 22.

When the indoor lighting device for the ceiling of the vehicle is assembled, initially, as shown in FIG. 2, the contact member 40 is attached to the switch knob 30 by pressing-in both the side edges of the base plate part 41 of the contact member 40 to the attaching grooves of the struts 32 on the back surface of the switch knob 30. Then, as shown in FIG. 3, the bus bars 20 are mounted on the upper surface 15*a* (see FIG. 9) of the bus bar support part 15 of the housing 10 and the pins 16 are thermally welded to fix the bus bars 20 to the housing 10.

Figure 4:
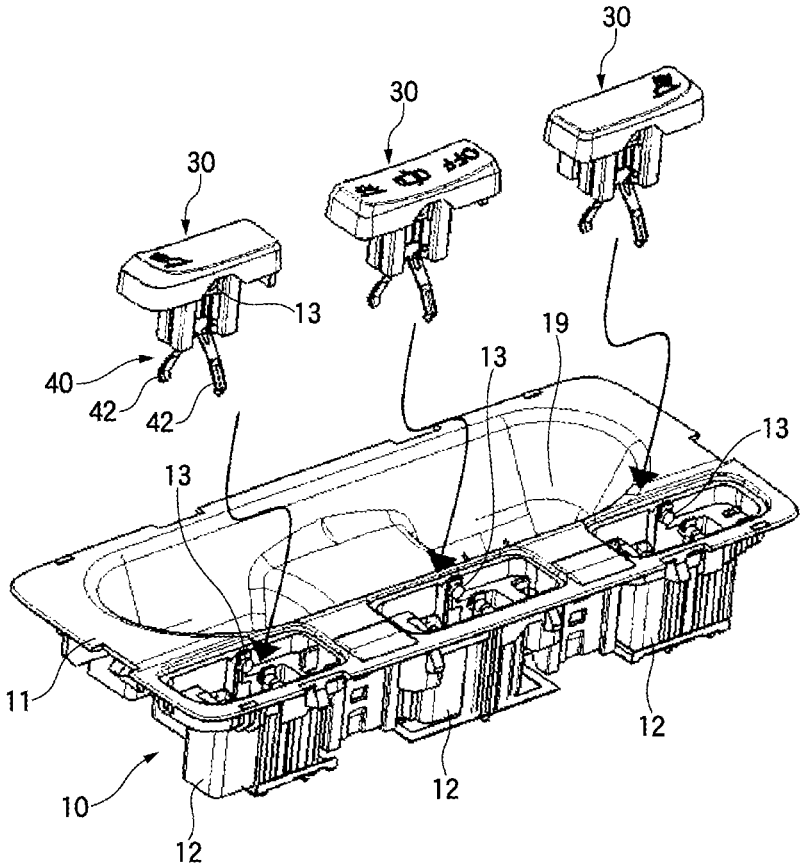
FIG. 4 is a perspective view showing a state that the switch knob having the contact member is to be attached to the housing having the bus bars attached to the back surface from a front surface side.
Figure 5:
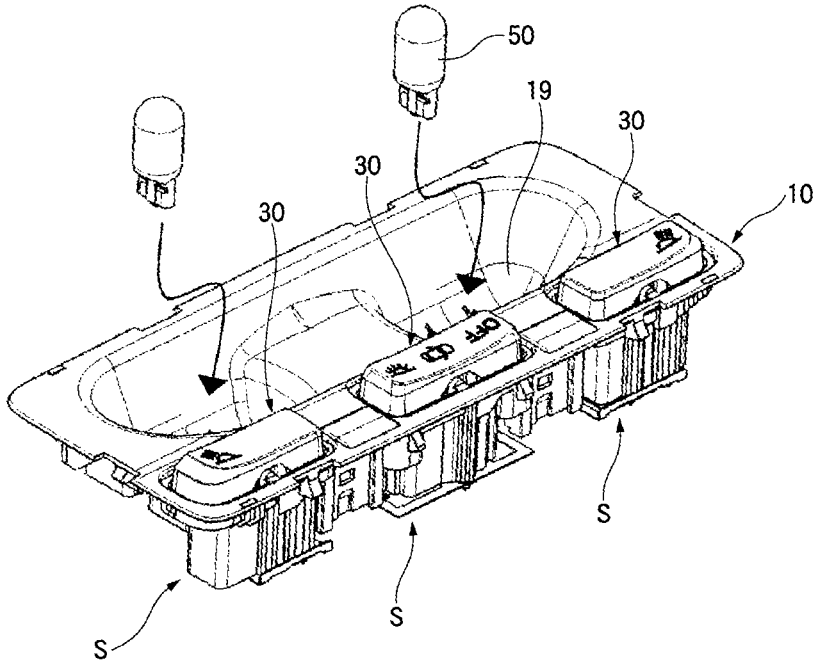
FIG. 5 is a perspective view showing state that a bulb is to be attached to the housing to which the switch knob having the contact member is attached.

Then, as shown in FIG. 4 and FIG. 5, the switch knob 30 is fitted to the tube part 12 of the housing 10 and the shaft hole 33 is fitted to a shaft protruding part (an illustration is omitted) protruding in an inner side surface of the tube part 12 so that the switch knob 30 is attached to freely swing. The switch knob 30 is attached to the tube part of the housing 10 in such a way, so that as shown in FIG. 10, the two arm springs 42 of the contact member 40 are inserted into the slide space 17 between the opposed movable contact slide parts 14 and the outer side surfaces of the arm springs 42 abut on the movable contact slide parts 14 so as to freely slide. At this time, as shown in FIG. 11, the arm springs 42 are pressed to come into contact with the movable contact slide parts 14 due to the resilient reaction force P of themselves. The switch knob 30 is attached to the tube part of the housing as described above so that the switch device S is completed. When the operating part 31 is pressed to be swung, a switching operation can be achieved.

Then, as shown in FIG. 5, the bulb 50 is attached to a bulb attaching part 19 of the housing 10. After that, as shown in FIG. 6, the cover 60 having the lens is attached to the housing 10 to locate a lens part 61 in front of the bulb 50. Further, a switch opening part 62 is fitted to the switch knob 30 to expose the operating part 31 of the switch knob 30 outside. Then, as shown in FIG. 7, the metal clips 70 are attached to the side parts of the housing 10 to complete the indoor lighting device for the ceiling of the vehicle.

Figure 13:
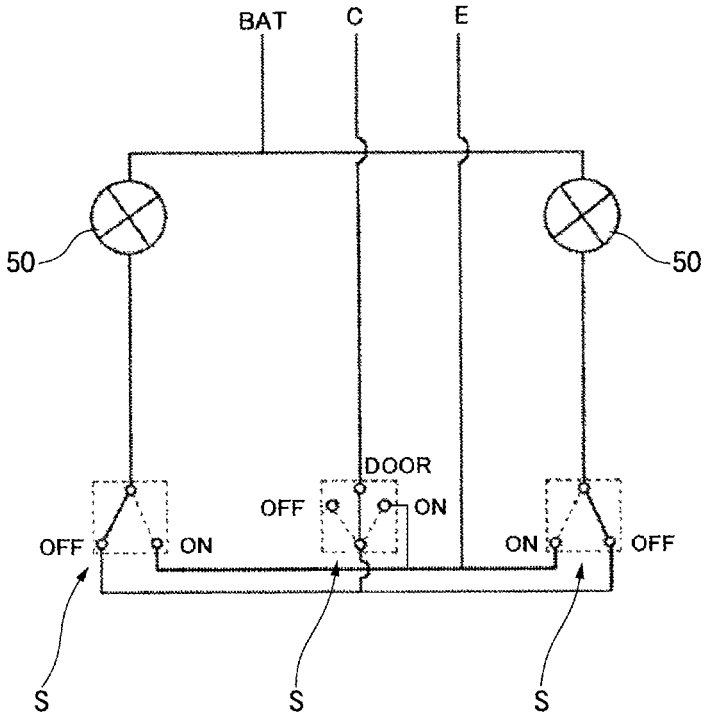
FIG. 13 is an electric circuit diagram of the lighting device for the ceiling of the vehicle.
Figure 14:
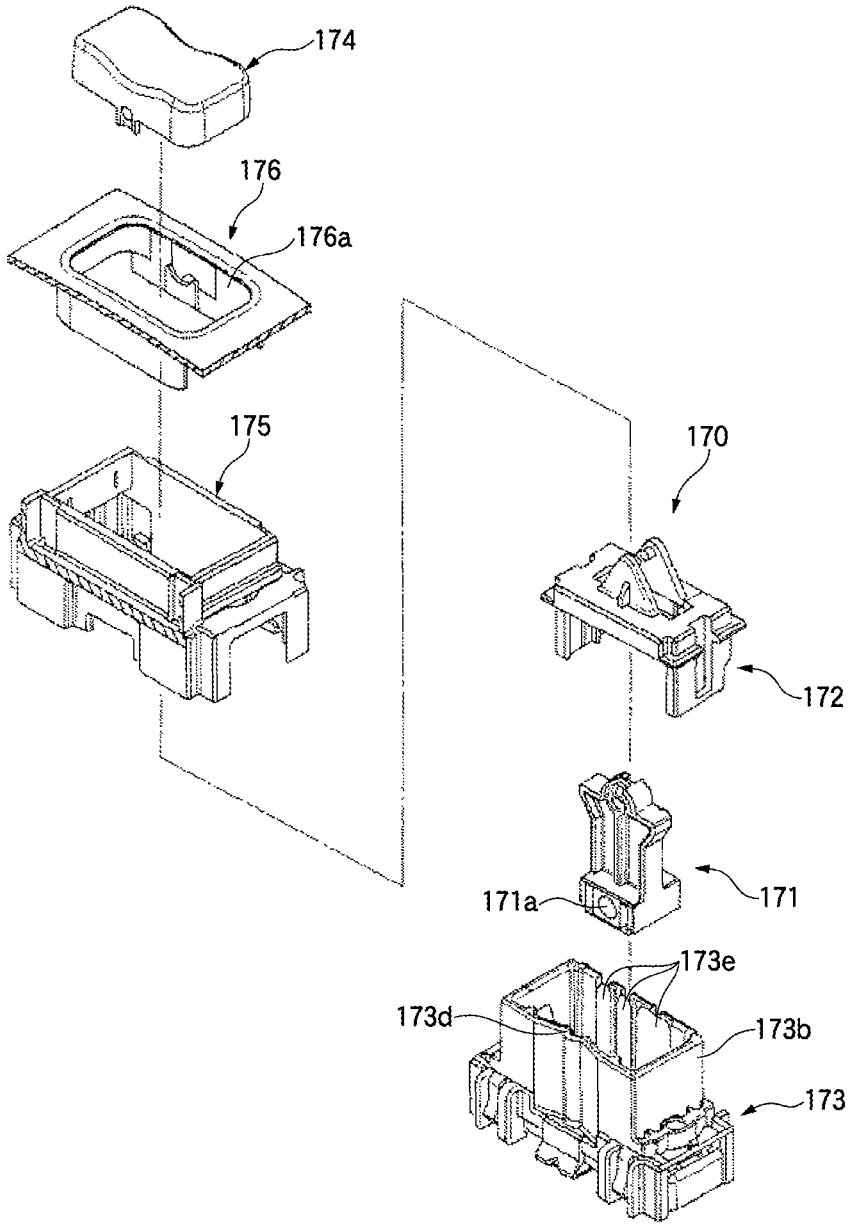
FIG. 14 is an exploded perspective view of a usual switch device.
Figure 15:
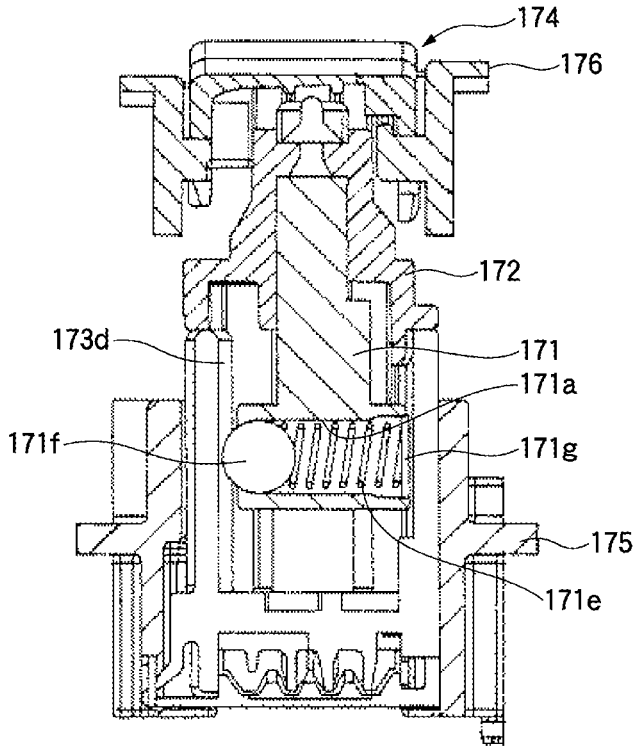
FIG. 15 is a structural view of the usual switch device and shows a sectional view cut by a surface including a central axis of swing of a switch knob.
Figure 16:
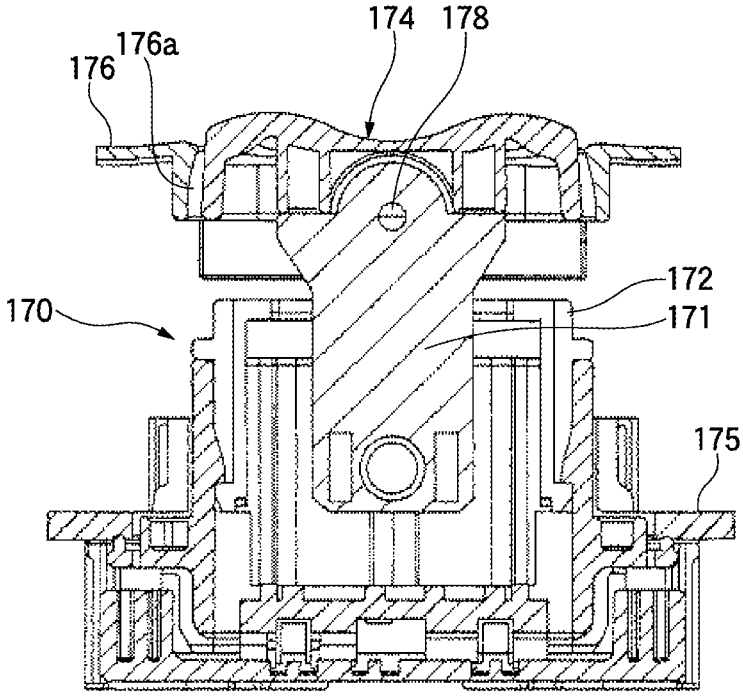
FIG. 16 is a structural view of the usual switch device and shows a sectional view cut by a surface orthogonal to the central axis of swing of the switch knob.

FIG. 13 is an electric circuit diagram of the indoor lighting device for the ceiling of the vehicle formed in such a way. The switch devices S at both ends show a type having two fixed contacts and the central switch device S shows a type having three fixed contacts.

Now, an operation of the indoor lighting device for the ceiling of the vehicle will be described below. When the arm springs 42 are resiliently engaged with the root parts 14*a* of the movable contact slide parts 14, the switch knob 30 of the switch device S is positioned at a prescribed position. Under a state that the arm springs 42 are positioned at positions of certain root parts 14*a*, when the switch knob 30 is switched to another position, the arm springs 42 get over mountain parts 14*b* so that the arm springs 42 are resiliently engaged with adjacent root parts 14*a*. Then, when the engaging positions of the arm springs 42 are switched, the connecting state of the bus bar 20 is switched.

At this time, since the root parts 14*a* and the mountain parts 14*b* are provided in the movable contact slide parts 14 and the arm springs 42 having a resiliency are allowed to slide on the movable contact slide parts 14 having the root parts 14*a* and the mountain parts 14*b*, a sense of moderation (a switching feeling) can be given to the operation of the switch knob 30 by a simple structure without using the spring or the engaging ball as in the usual example. Namely, when the arm springs 42 slide in the loci of mountain forms as shown by arrow marks N of dotted lines in FIG. 11, a good sense of moderation can be formed. Accordingly, the number of parts is reduced and the number of attaching processes is reduced, so that a cost can be lowered.

Further, as shown in FIG. 10, since the end edges of parts of the bus bars 20 are used as the fixed contacts 22 and the arm springs 42 as the movable contacts abut on the end edges, dust or a foreign material is hardly interposed between the fixed contacts 22 and the arm springs (the movable contacts) 42. Thus, reliability in a connection between the fixed contacts 22 and the arm springs (the movable contacts) 42 can be improved.

Especially, in the switch device S, in the corner parts of the upper surface 15*a* of the bus bar support part 15 of the housing 10, the cut out parts 15*b* are provided which allow the end edges of the bus bars 20 as the fixed contacts 22 to protrude outside from the bus bar support part 15. Further, the arm springs 42 are inclined to the bus bar 20 so that the outer side surfaces of the bar shaped arm springs 42 having the mountain forms in section abut on the upper side edges 22*a* of the fixed contacts 22. Accordingly, even when a small attaching error occurs between the housing 10, the bus bars 20 and the contact member 40 or work errors slightly occur in these parts respectively, as shown in a part Q in FIG. 10(*b*), the arm springs 42 can be assuredly allowed to come into contact with the fixed contacts 22 to avoid an imperfect electric conduction.

Figure 12:
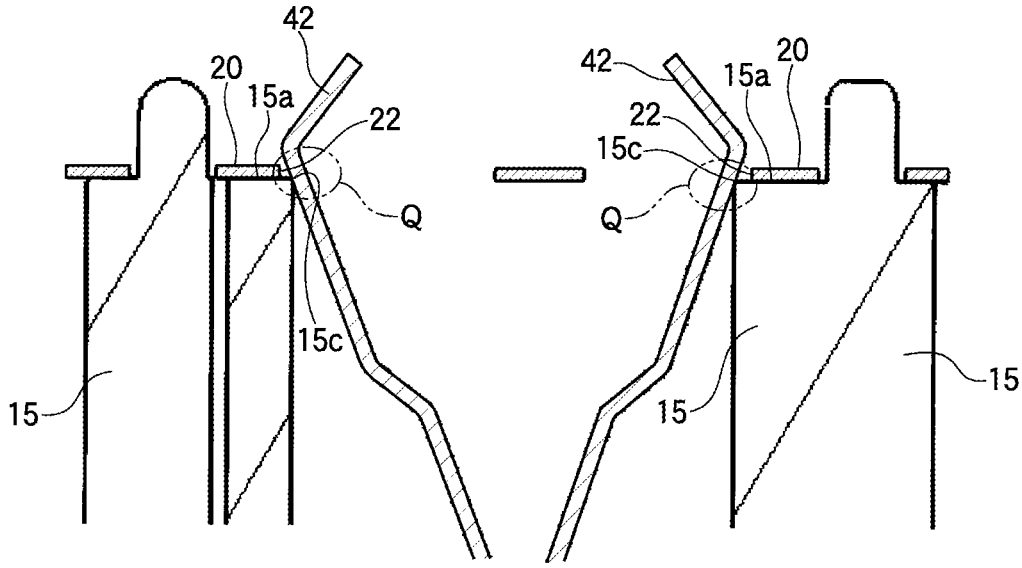
FIG. 12 is a diagram showing a comparative example to FIG. 10(*b*), which illustrates a state that a cut-out part [a part shown by reference numeral 15*b* in FIG. 10(*b*)] is not formed in a corner part 15*c* of an upper surface 15*a* of a bus bar support part 15, the corner part 15*c* of the upper surface 15*a* of the bus bar support part 15 protrudes outward from a fixed contact 22 formed with an end edge of the bus bar 22 from the viewpoint of a problem of molding or attachment, so that an arm spring 42 as a movable contact hardly comes into contact with the fixed contact 22.

In this connection, as shown in a comparative example in FIG. 12, when cut out parts are not formed in corner parts 15*c* of an upper surface 15*a* of a bus bar support part 15, and the corner parts 15*c* of the upper surface 15*a* of the bus bar support part 15 protrude outward from fixed contacts 22 formed by end edges of a bus bar 20 owing to a problem in view of molding or attachment, accordingly, arm springs 42 as movable contacts hardly come into contact with the fixed contacts 22. The switch device S of the present exemplary embodiment can avoid such a problem.

Further, in the switch device S having the above-described structure, since the two arm springs 42 as the movable contacts are provided in the contact member 40 in the form of V and the arm springs 42 are allowed to slide on the movable contact slide parts 14 opposed to each other with the slide space 17 of the arm springs 42 sandwiched between them, the fixed contact 22 arranged in one movable contact slide part 14 side can be electrically conducted to the fixed contact 22 arranged in the other movable contact slide part 14 side through the contact member 40. Namely, the two bus bars 20 can be connected to each other or disconnected from each other by a simple structure.

The present invention is not limited to the above-described exemplary embodiment and a modification or an improvement may be suitably made. The materials, forms, dimensions, number arranged positions or the like of the components in the above-described embodiment may be arbitrary and are not limited as long as they can achieve the present invention.

The present application is based on Japanese Patent Application No. 2010-151725 filed on Jul. 2, 2010, the entire contents of which are incorporated herein by reference.

INDUSTRIAL APPLICABILITY

According to the present invention, reliability in a connection between a fixed contact and a movable contact can be improved, a sense of moderation can be given to an operation of a switch knob by a simple structure and a cost can be lowered by reducing the number of parts and the number of attaching processes.

REFERENCE SIGNS LIST

S: Switch Device
1: Main Body
10: Housing
14: Movable Contact Slide Part
14*a*: Root Part
14*b*: Mountain Part
15: Bus Bar Support Part
15*a*: Upper Surface
15*b*: Cut Out Part
20: Bus Bar
22: Fixed Contact
22*a*: Upper Side Edge
30: Switch Knob
40: Contact Member
42: Arm Spring (movable contact)

The invention claimed is:

1. A switch device including:

a main body having a housing made of an insulating resin and bus bars made of an electrically conductive material;

a switch knob provided on the main body so as to be switched;

movable contacts that have a resiliency and slide in accordance with a switching operation of the switch knob;

movable contact slide parts provided in the main body on which the movable contacts come into resilient contact and slide;

a plurality of root parts and mountain parts between the root parts which are formed in the movable contact slide parts and with which the movable contacts can be selectively engaged; and a fixed contact formed with an end edge of the bus bars and provided in the root parts, wherein the movable contacts slide so that engaging positions of the movable contacts are switched from one root parts of the plurality of root parts to the other root parts to switch a connecting relation between the movable contacts and the fixed contacts.

2. A switch device according to claim 1, wherein the bus bars are mounted and fixed to an upper surface of a bus bar support part provided in the housing, a cut out part which allows the end edges of the bus bars as the fixed contact to protrude outward from the bus bar support part is provided on the upper surface of the bus bar support part, the movable contacts are formed in the shapes of bars having mountain forms in section fitted to the root parts, and the movable contacts are extended in the vertical direction to plate surfaces of the bus bars and arranged to be inclined so that outer side surfaces abut on upper side edges of the fixed contacts.

3. A switch device according to claim 1, wherein the movable contact slide parts are arranged to be opposed to each other with a slide space sandwiched between them, the plurality of root parts and the mountain parts between the root parts are respectively provided in the movable contact slide parts arranged to be opposed to each other, the switch knob is formed as a seesaw switch knob provided in the housing so as to freely swing, a contact member is attached to the switch knob, two arm springs as the movable contacts are formed in the contact member in the shape of V, and the two arm springs are inserted into the slide space between the movable contact slide parts arranged to be opposed to each other so that the arm springs may freely slide respectively relative to the movable contact slide parts.

* * * * *